United States Patent [19]

Glover et al.

[11] Patent Number: 5,054,256

[45] Date of Patent: Oct. 8, 1991

[54] PANEL JOINTING SYSTEM

[75] Inventors: John E. S. Glover, Angmering; Timothy N. Glover, Worthing; Andrew J. Miller, Claygate, all of England

[73] Assignee: Thermabate Limited, Angmering, England

[21] Appl. No.: 436,723

[22] Filed: Nov. 15, 1989

[30] Foreign Application Priority Data

Nov. 16, 1988 [GB] United Kingdom ..... 8826833

[51] Int. Cl.[5] ..... E04B 1/61

[52] U.S. Cl. ..... 52/765; 52/584

[58] Field of Search ..... 52/765, 766, 763, 762, 52/582, 584, DIG. 2, 746, 363, 362, 361

[56] References Cited

U.S. PATENT DOCUMENTS

| | | | |
|---|---|---|---|
| 1,879,457 | 9/1932 | Paulsen | 52/361 X |
| 2,403,580 | 7/1946 | Cartwright et al. | 52/765 X |
| 3,890,753 | 6/1975 | Johansen | 52/766 |
| 3,896,598 | 7/1975 | Yoshida | 52/766 |
| 4,033,079 | 7/1977 | Cross, Jr. | 52/765 X |

FOREIGN PATENT DOCUMENTS

| | | | |
|---|---|---|---|
| 980973 | 1/1976 | Canada | 52/765 |

*Primary Examiner*—Philip C. Kannan

*Attorney, Agent, or Firm*—Lon H. Romanski

[57] ABSTRACT

A panel jointing system comprises an alignment strip having locating surfaces to engage the adjacent margins of the faces of two coplanar panels, and engaging means being provided in association with the strip to retain the panels in position. The engaging means preferably acts by penetrating the edge of the panel material, and may comprise a pair of flexible barbed projections extending from the strip, which may be flexed to embed the barbs into the respective panel edges. The barbs may be flexed by inserting an expansion element between them to force them apart. Alternatively, the engaging means may be a plurality of blade elements which may be embedded into the panel edges and also be retained by the strip.

10 Claims, 6 Drawing Sheets

PANEL JOINTING SYSTEM

FIELD OF THE INVENTION

The present invention relates to the joining of panels, and is particularly concerned with a system for forming butt joints between coplanar building panels such as plasterboard ceiling panels.

BACKGROUND OF THE INVENTION

Currently, when constructing a ceiling from plasterboard sheets, regulations require the edges of all sheets to be supported by fixing to joists or to noggins running between the joists. Clearly, the cutting to length of the noggins and their fixing between joists is a time consuming operation and increases building costs.

SUMMARY OF THE INVENTION

The present invention seeks to provide a jointing method for plasterboard panels which ensures support and alignment between adjacent edges of abutting panels without the use of noggins.

According to the present invention, a panel joining system includes an alignment and securing strip adapted to align the panel edges to be jointed, and engaging means on the strip capable of retaining the panel edges in position. The engaging means preferably acts by penetrating into the panel material through the said edges of the respective panels to retain the panels in position.

In a first embodiment of the invention, an alignment and securing strip includes a pair of spaced parallel locating surfaces adapted to engage the edges of the panels to preserve a predetermined spacing therebetween, and a pair of flexible walls extending substantially parallel to the abutment surfaces, the walls carrying outwardly facing barbs capable of gripping the panel edges when the flexible walls are deflected away from one another.

A panel jointing system according to the first embodiment of the invention may comprise an alignment and securing strip and a plurality of separate expansion elements capable of being positioned between the flexible walls to urge them apart. The expansion elements may be provided with cam surfaces and may be introduced between the flexible walls and then rotated so that the cam surfaces engage the flexible walls and urge them apart.

The expansion elements may be elongated, and may be introduced by aligning them with the joint direction, inserting them in a direction along an insertion axis at right angles to the joint direction, and finally rotating them about the insertion axis so that the ends of the alignment elements engage the flexible channel walls.

Advantageously, resilient latch means may be provided to secure the alignment elements in place.

As an alternative to cam surfaces, the expansion elements may each comprise a wedge type element which is inserted between the flexible walls to urge them apart. The wedge element may be conical and may include a threaded stem extending axially from its apex, the stem being received in an opening in a web extending between the flexible walls, so that rotation of the wedge element draws the conical part thereof axially between the flexible walls to urge them apart.

In any of the above described constructions, the flexible walls may be non-resilient so that once urged apart the barbs engage the panel edges and remain embedded therein even if the expansion element is removed. In such constructions, the expansion element may be an expansion tool engageable between the flexible walls to force them apart locally, the tool being released from between the flexed walls to be re-applied at spaced locations along the alignment and securing strip.

In yet a further alternative embodiment, the alignment and securing strip comprises a planar strip from which a pair of spaced flexible webs extend, the strip extending laterally beyond the webs to form two alignment flanges, and the area of the strip between the webs being slit to define a plurality of swingable expanding portions. The webs converge slightly towards their free edges, and are formed at their free edges with outwardly-facing longitudinal barbs. By swinging the expansion portions out of the plane of the strip to a position between the webs, the webs are urged outwardly to engage the barbs into the edges of the panels while the alignment flanges engage the edge regions of the panel faces. The expansion portions are preferably rectangular and have their outlines defined by three slits arranged in "C" formation, with the remaining side of the rectangle acting as a plastic hinge. An opening may be formed in the strip adjacent to the expansion portion to facilitate the swinging of the expansion portion out of the plane of the strip.

According to a second embodiment of the invention, locating surfaces are provided by a pair of parallel walls formed on an alignment and securing strip and adapted to engage the edges of a pair of panels, a web extending between the walls and being perforated at intervals to accept a securing means, the securing means including an elongate blade and a fixing stud and being so configured that by aligning the blade parallel to the strip the fixing stud may enter one of the perforations in the web, and by then rotating the blade to an orientation generally transverse to the strip the blade ends become embedded in the panel edges and the fixing stud is held in the perforation against withdrawal.

Preferably the strip and the blade are of plastics material, but metallic blades are also foreseen. The blade is preferably formed with cutting edges to facilitate entry into the panel material. The perforations in the web may be replaced by an undercut slot defined between two flanges.

The alignment strip of either embodiment may be fixed to a first one of the panels by adhesives, or by fasteners such as nails or the like.

The invention will now be described in detail with reference to the accompanying drawings.

BRIEF DESCRIPTION OF THE DRAWINGS

In the drawings, wherein for purposes of clarity certain details and/or elements may be omitted from one or more views.

DETAILED DESCRIPTION OF THE PREFERRED EMBODIMENTS

Figure 1:
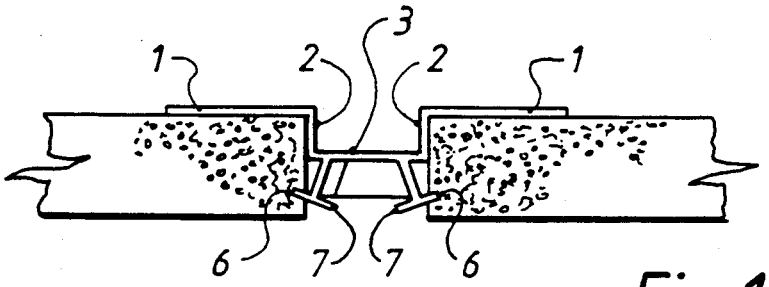
FIG. 1 is an end view of a joint using the jointing system of the first embodiment of the invention.
Figure 2:
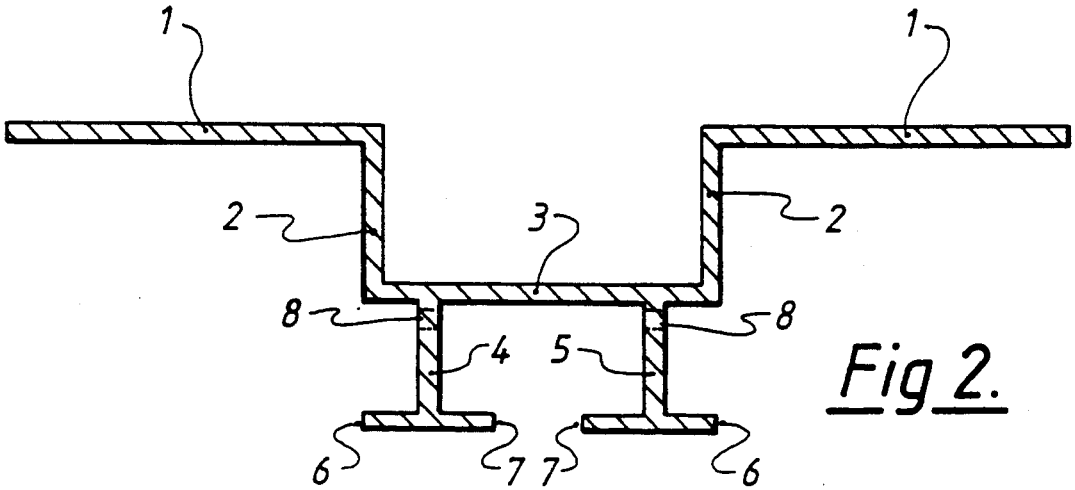
FIG. 2 is an end view, in relatively enlarged scale, of the alignment and securing strip of FIG. 1.

Referring now to FIGS. 1 and 2, the alignment strip shown comprises a pair of coplanar flanges 1 and two outwardly facing abutment surfaces 2 Joined by a web 3 to form an inverted "top hat" section.

Extending downwardly from the web 3 are two flexible walls 4 and 5, at whose free ends are formed outwardly extending flanges 6 and inwardly extending flanges 7. The flexible walls 4 and 5 are perforated by holes 8, the holes being aligned to accept fasteners for temporarily fixing the strip in place.

Figure 3:
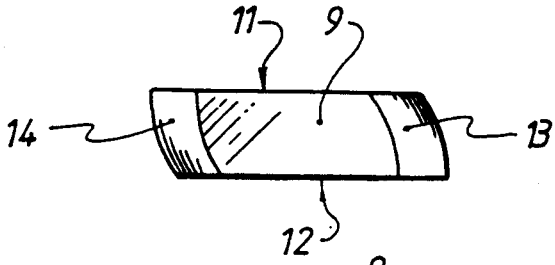
FIGS. 3 and 4 are plan and side views, respectively, of an expansion element drawn to the same scale as FIG. 2.
Figure 4:
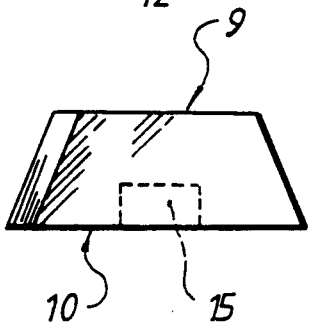

FIGS. 3 and 4 show an expansion element for use with the strip of FIG. 2. The expansion element is generally trapezoidal in side view, and has an upper surface 9 and a lower surface 10 parallel thereto.

Trapezoidal side faces 11 and 12 extend between the upper and lower surfaces 9 and 10, and curved and inclined end cam faces 13 and 14 complete the expansion element. A non-circular recess 15, such as a slot for a screwdriver or a hexagonal recess to accept an Allen key, is formed centrally in the lower surface 10.

It will be observed from the Figures that the expansion element is so dimensioned as to be insertable between the flanges 7 when offered up with its upper surface 9 parallel to the web 3 and its longest dimension aligned with the joint direction.

In use, two panels are butt jointed using the system of the present invention in the following way.

Figure 5A:
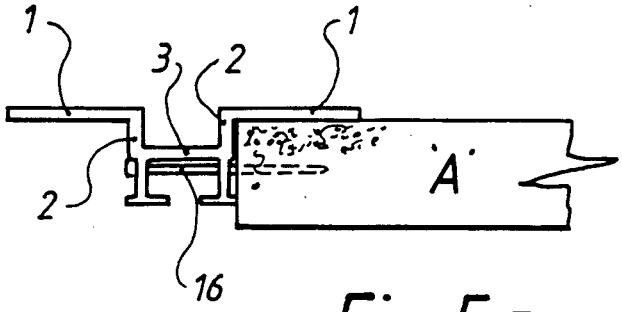
FIGS. 5A and 5B and 5C show the stages in completing the alignment and fixing of panels to be joined using the system of FIGS. 1 to 4.

First, one panel A has the alignment strip secured to it by means of fasteners 16 extending through the openings 8 and entering the panel edge as seen in FIG. 5A. Alternatively or additionally, an adhesive bond between the panel A and the flange 1 and/or the abutment surface 2 may be made.

The panel A is then offered up and fixed in position, for example by nailing through the panel into supporting timbers.

Figure 5B:
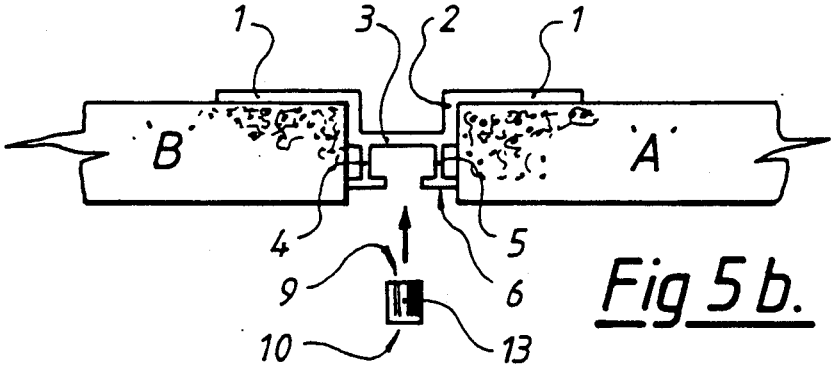

Panel B is then offered up and secured in position, with its edge abutting the other abutment surface 2 of the alignment strip. It will be observed from FIG. 5B that in this position the flexible walls 4 and 5 are parallel, and the outer edges of the flanges 6 are in contact with the edges of the panels A and B.

An alignment element is then inserted between the walls 4 and 5, so that the upper surface 9 contacts the web 3. A screwdriver or other tool (not shown) inserted into the recess 15 in the exposed underside 10 of the expansion element is then turned through approximately 90°, causing the expansion element to rotate.

Figure 5C:
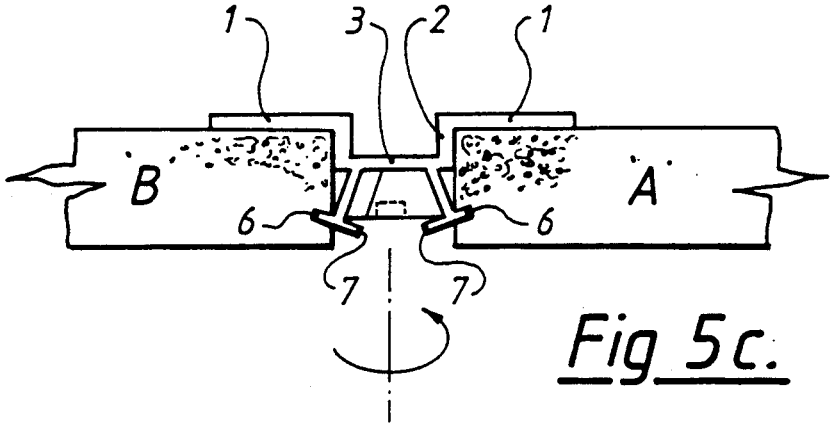

This rotation brings the cam surfaces 13 and 14 into contact with the flexible walls 4 and 5, deflecting them outwardly, as seen in FIG. 5C. This causes the flanges 6 to become embedded in their respective adjacent panel edges, with a slight upward rotation which urges the panels into close contact with their respective flanges 1. This ensures correct alignment between the panels A and B.

The joint is then completed by filling the space between the panel edges with a plaster, it being noted that the flanges 7 extending inwardly from the ends of the flexible walls 4 and 5 serve not only to retain the expansion elements against ejection, but also as a "key" to retain the plaster. Flexible walls 4 and 5 may be perforated at intervals to allow the plaster to flow through the perforations and aid retention.

Resilient latching configurations may be used to retain the expanding element in its rotated position, such latching configurations comprising detents formed on the flexible walls 4 and 5 or on the flanges 7 to engage ratchet teeth on the expansion element to resist undesired rotation of the expansion element.

As an alternative to the flanges embedding themselves in the panel edge, the flexible walls 4 and 5 may be so dimensioned that the flanges 6 engage the face of the panel when the expansion elements are in place. While this will not give a flush joint when plaster is laid between the panels, it may be useful in certain applications where a flush finish is not necessary. An arrangement where the panels are gripped between flanges 6 and 1 may, for example, be of use in demountable displays for use at exhibitions.

As an alternative to the use of expansion elements such as are shown in FIGS. 1 through 5C, the alignment and securing strip may be formed, for example, from metal such as aluminum so that the flexible walls will remain in their outwardly deflected position when the expanding force is removed. In this way it is possible to contemplate the use of an expanding tool in place of the expanding elements, the expanding tool being inserted sequentially at a plurality of locations along the strip to deflect the flexible walls outwardly to engage the panels.

Figure 6:
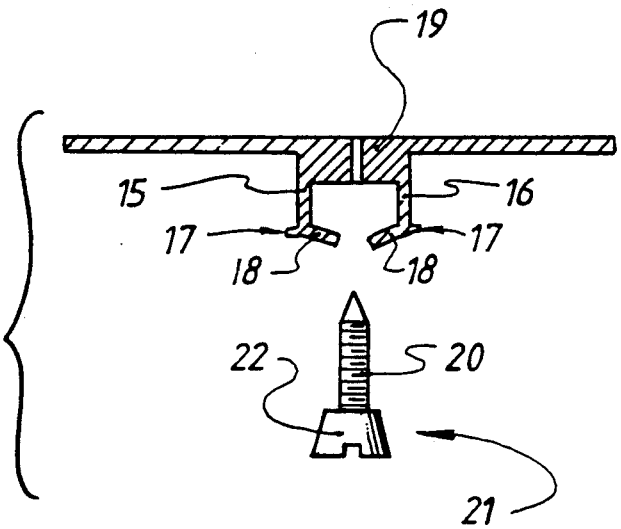
FIG. 6 is an end view of a second embodiment of joint system employing teachings of the invention.

Referring now to FIG. 6, an alternative embodiment of the invention is shown wherein an alignment strip is provided with flexible walls 15 and 16 equipped at their free ends with outwardly extending barbs 17 and inwardly directed flanges 18. A web 19 between the flexible walls 15 and 16 is thickened and perforated to accept a threaded shank 20 of an expansion element 21. The expansion element 21 further includes a conical expanding head 22, slotted at 23 to accept a screwdriver.

In use, the alignment strip of FIG. 6 is installed exactly as described in relation to the strip of FIGS. to 5C, but the final fixing of the panels is achieved by engaging the shank 20 of an expanding element 22 into one of the perforations in web 19, and rotating the expansion element so that its thread draws the expansion element upwardly. As will be apparent, the end faces of the flanges 18 will contact the conical surface of the expanding head 22, and as the expansion element moves upwardly the flexible walls will be forced apart, embedding the barbs 17 into the panel edges. It is possible, by appropriate design of the alignment strip, to allow conventional countersunk screws to be used as expansion elements.

Figure 7:
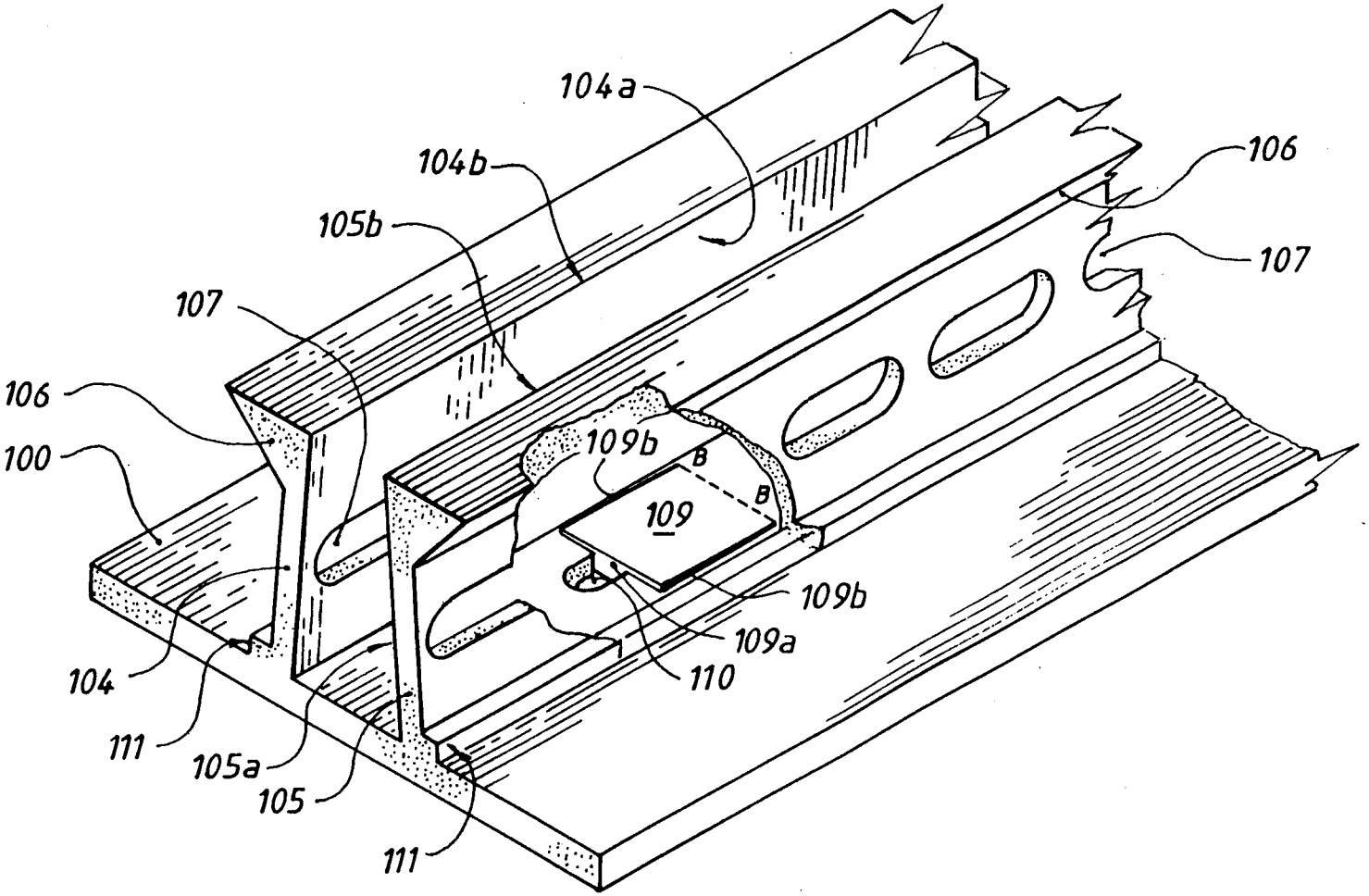
FIG. 7 is a partially cutaway perspective view of a part of an alignment and securing strip according to a third embodiment of the invention.
Figure 8:
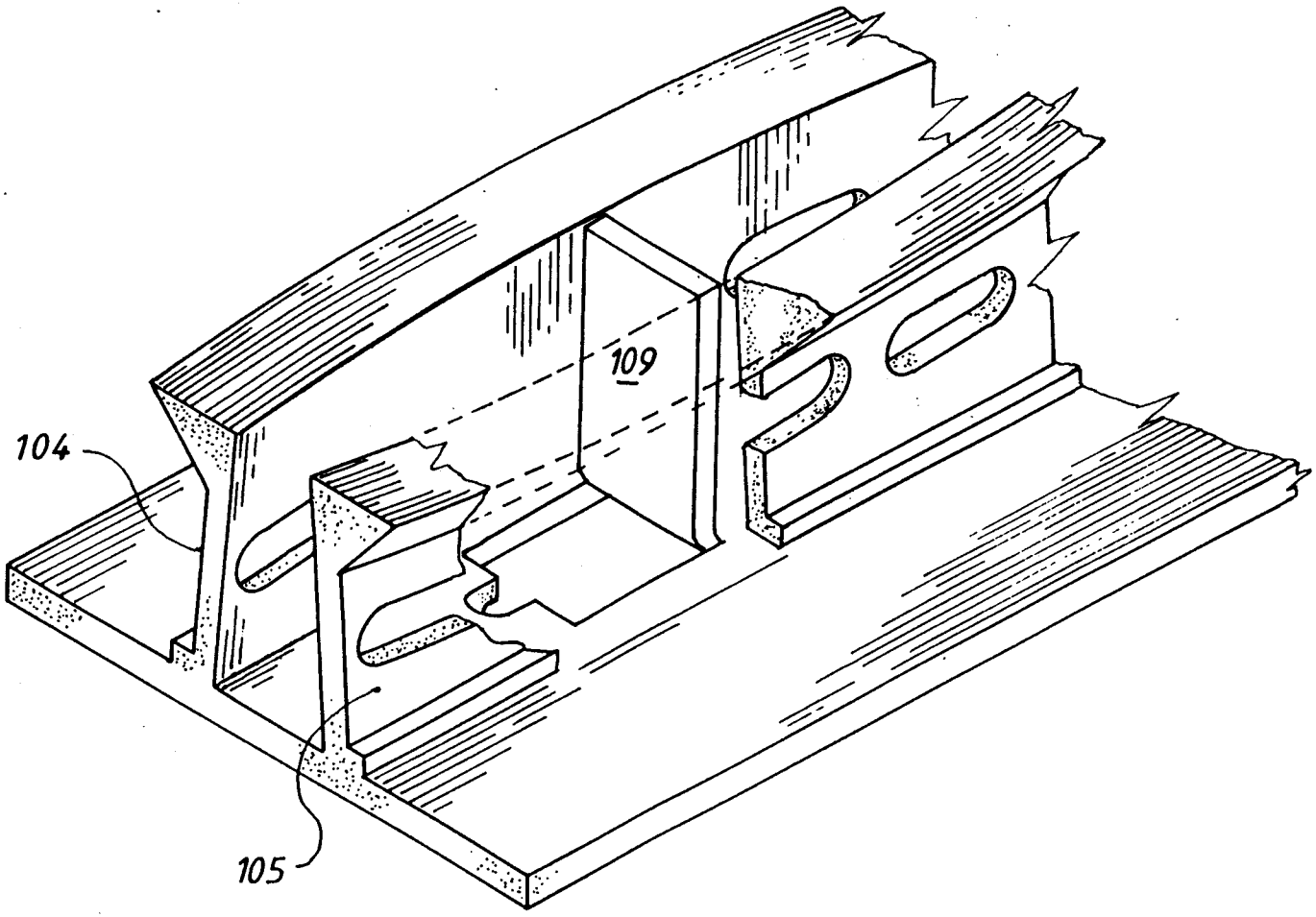
FIG. 8 is a view similar to FIG. 7 showing the flexible webs of the alignment strip in their laterally expanded position.
Figure 9:
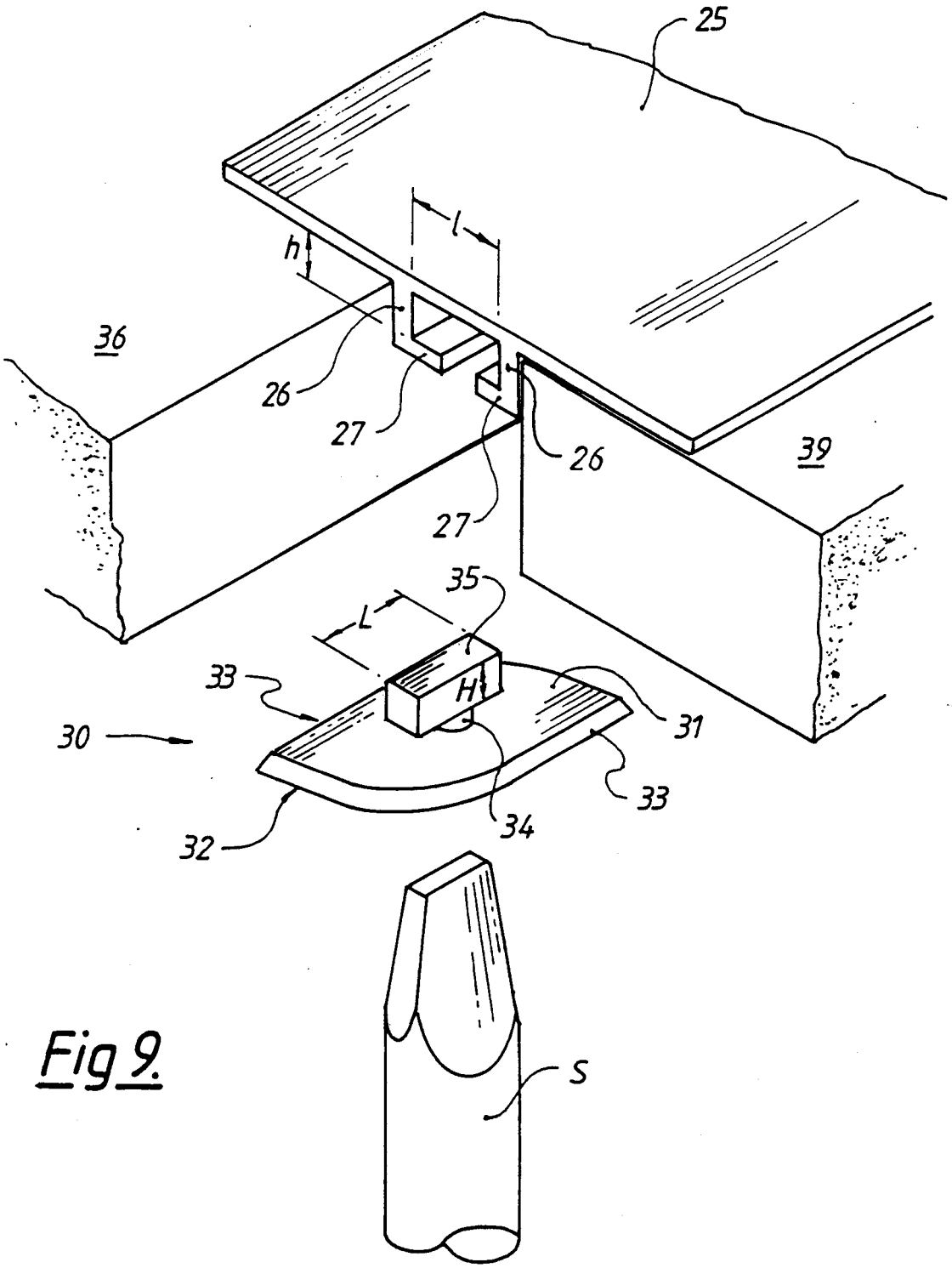
FIG. 9 shows, in relatively enlarged scale, the components of a jointing system according to a fourth embodidment of the invention.

In a third embodiment of the invention, shown in FIGS. 7 and 8, the alignment and securing strip and the expansion elements are parts of an integrally formed component. This is achieved by extruding and perforating a strip of plastics or metal, as will be described.

FIG. 7 shows an alignment strip having an elongate planar base 100. Upstanding from the central part of the base 100 are a pair of longitudinally extending spaced walls 104 and 105. It is clear from the view of FIG. 7 that the walls are inclined rather than perpendicular to the base, so that the facing surfaces 104*a* and 105*a* converge towards their free edges 104*b* and 105*b*.

At their free edges, the walls 104 and 105 are formed with outwardly facing projections 106 having a sharp longitudinal edge. The walls 104 and 105 may also be perforated, as at 107, to reduce material cost and to provide a plaster key.

In the region of the base 100 between the walls, rectangular expansion portions 109 are defined at intervals along the base 100 by sets of three slits 109*a*, 109*b*, 109*c*, arranged in a "C" formation, the fourth side of the rectangle being a bend line B—B. Adjacent the expansion portion 109, on its side opposite the bend line B—B, an opening 110 is formed in the base 100.

The transverse dimension of the expansion portion is arranged, by virtue of the inward inclination of the walls 104 and 105, to be greater than the clearance between the upper edges 104*b* and 105*b* when unstressed. The longitudinal dimension of the expansion portion is so arranged that, when bent up at 90° to the plane of the base about bend line B—B, the expansion portion has a height substantially equal to the height of the walls 104, 105.

In use, the alignment and securing strip is initially installed by fixing it to a panel edge so that the base 100 contacts the rear face of the panel and the panel edge engages the longitudinal edge of one of the projections 106. A supplementary locating surface, such as the step 111, may be provided adjacent the foot of the walls 104 and 105, to ensure accurate location.

With the first panel and the strip fixed in position, a second panel is offered up and fixed in position with its edge contacting the remaining projection 106 (and the step 111 if provided).

A suitable tool may then be inserted through the opening 110 and manipulated to lever the expansion portion 109 out of the plane of the base 100, by bending the base material along bend line B—B.

During the lifting of the expansion portion 109, the edges of the expansion portion engage the facing surfaces of the walls 104 and 105 and urge them apart, causing the projections 106 to become embedded in the material of the panels. Clearly, if the walls 104 and 105 are perforated, then unperforated sections must be left adjacent to the expanding portions 109, so that a sliding cam action may occur between the walls and the lateral edges of the expansion portion. FIG. 8 shows an expansion portion 109 in its raised position, the walls 104 and 105 being locally forced apart.

The strip shown in FIGS. 7 and 8 clearly has advantages over the previous embodiments, principally in that there are no small loose components which may become mislaid, and in that the pitch between expansion portions 109 is predetermined, leaving a user in no doubt as to the spacing required between the expansion elements. The opening 100 may be configured to accept a common screwdriver, or a special tool may be used to extend through the opening 110, and engage and lift the expansion portion 109.

A fourth embodiment of the invention is shown in FIGS. 9 to 12, wherein the locating means of the jointing system comprises a strip 25 having two spaced parallel locating walls 26 depending therefrom. Extending laterally from the adjacent faces of the two locating walls 26 are a pair of retaining flanges 27. The area of the strip 25 between the locating walls is thickened for improved rigidity. It is possible also to provide a flange upstanding from the strip 25 to reduce flexibility of the strip.

The panels are held in position by means of a plurality of securing elements 30, each of which comprises an elongated flat blade 31 having sharpened end edges 32, diagonally opposing corners of the blade being rounded or profiled to achieve a gradual transition from the side edges 33 to the end edges 32.

The underside of the blade 31 is slotted to receive a turning tool such as a screwdriver, S.

Extending upwardly from the blade 31 is a retaining portion comprising a circular stem 34 carrying at its free end a retaining head 35. The retaining head 35 is here shown as a parallelepiped, but may be rounded at two diagonally opposite corners for reasons which will become apparent. The dimensions and orientation of the head 35 are such that, with the blade 31 aligned in the direction of the joint, the head 35 may pass between the flanges 27 of the locating strip 25. The height, H, of the head corresponds to the height, h, between the flange 27 and the undersurface of strip 25, and the length, L, of the head corresponds to the spacing, 1, between the adjacent faces of the locating walls 26.

Figure 10:
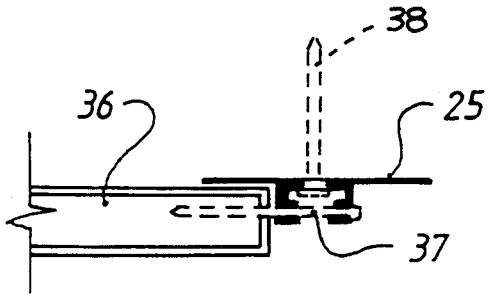
FIGS. 10, 11 and 12 are end views of a joint between two panels in various stages of completion.
Figure 11:
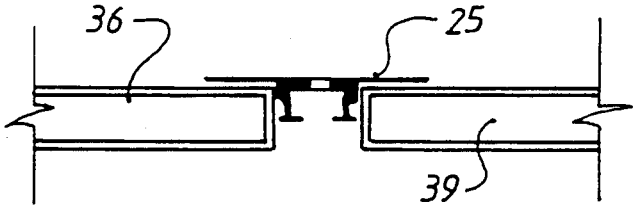
Figure 12:
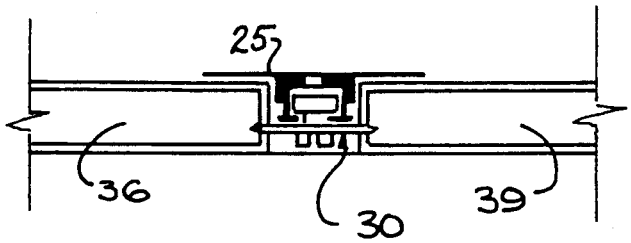

In use, as seen in FIGS. 10 to 12, the strip 25 is first secured to an edge of a first panel, for example a plasterboard ceiling panel 36, by means of nails 37 passing through the locating walls 26 or through aligned holes formed therein. The panel 36 is then fixed in position by nailing through the panel into supporting timber, as is conventional. Additional fixing for the strip 25 may be achieved by nailing directly through the strip 25 into supports, where this is practicable, using nails 38 either passing through the strip 25 or through perforations therein.

The adjacent panel 39 is then offered up into position, its edge abutting the locating wall 26 of the strip 25, and is fixed by nailing through to the supporting timber.

To secure the panel edges together, a securing element 30 is positioned on screwdriver S by engaging the screwdriver in the slot in its underside, and is inserted upwardly into the space between the panel edges with the longer dimensions of the head 35 and blade 31 aligned with the joint direction.

When the upper surface of the head 35 contacts the underside of the strip 25, the operative urges both panels into close engagement with the strip and simultaneously rotates the securing element 30 by about 90°.

This causes the element 30 to adopt the position shown in FIG. 12, with the head 35 positioned between the locating walls 26 and supported vertically on the flanges 27, and the end edges 32 of the blade 31 embedded in the respective panel edges. The space between the panels 36 and 39 may now be filled with plaster to achieve a flush surface finish.

The end edges 32 of the blade 31 are preferably formed as chisel edges, the undersurface of the blade 31 being flat and the end faces of the blade meeting the underside at an acute angle.

The blade 31 may advantageously be twisted to impart a screwing motion to its penetration of the panel edges, so that as the securing element is rotated the panels 36 and 39 are urged upwardly against the strip 25.

In a further advantageous development, the head 35 of the securing element may include stop surfaces to prevent rotation beyond 90°, and resilient retaining means may operate between the flanges 27 and the head 35 to prevent reverse rotation of the securing element.

While the securing element 30 has been described for use with an applicator tool (screwdriver S), it is possible to fabricate the securing element in such a way as to provide a grip which may be grasped in the hand to insert and rotate the securing element, and may then be detached therefrom by means of a frangible connection.

The strip 25 is preferably extruded from plastics material, but may also be of metal such as aluminum. The securing elements 30 may be injection moulded from hard plastics material, or may be fabricated from metal.

What is claimed is:

1. A panel jointing system including an alignment and securing strip adapted to align the panel edges to be jointed, and engaging means on the strip capable of retaining the panel edges in position, wherein said alignment and securing strip comprises a pair of spaced parallel abutment surfaces adapted to engage the edges of the panels to preserve a predetermined spacing therebetween, and a pair of flexible walls extending substantially parallel to the abutment surfaces, the walls carrying outwardly facing barbs capable of gripping the panel edges when the flexible walls are deflected away from one another.

2. A panel jointing system according to claim 1, and further comprising elongate expansion elements introduced between the flexible walls of the strip so as to have the longitudinal axes of the elongate expansion elements parallel to that of the strip, and wherein the expansion elements are rotatable so that their longitudinal axes lie transversely to the strip, the ends of the expansion elements engaging inner faces of the walls to urge the walls apart during rotation of the expansion elements.

3. A panel jointing system according to claim 2, and further including means to retain the expansion elements in their rotated position between the walls.

4. A panel jointing system according to claim 1, wherein the walls are deflected outwardly by a number of wedge elements.

5. A panel jointing system according to claim 4, wherein the wedge elements have a conical head and have a threaded shank extending axially from the apex of the cone, the shank being threadably engageable in an opening in the strip between the flexible walls so that rotation of the wedge element draws the conical head into the space between the walls, deflecting them outwards.

6. A panel jointing system according to claim 1, wherein the strip has flexible walls whose facing surfaces are convergent towards their free edges, and the strip is formed between the walls with a number of expanding portions which, when bent out of the plane of the strip, engage the facing surfaces of the walls to urge them apart.

7. A panel jointing system according to claim 6, wherein the expanding portions are rectangular and are defined on one side by a bend line and on the remaining three sides by slits.

8. A panel jointing system according to claim 7, wherein an opening is formed in the strip adjacent to that side of each expanding portion which is opposite the bend line.

9. A panel jointing system according to claim 1, wherein the flexible walls are formed with keying formations to assist in the adhesion of plaster to the strip.

10. A panel jointing system according to claim 9, wherein the keying formations are perforations.

* * * * *